US011168385B2

(12) United States Patent
Luo et al.

(10) Patent No.: US 11,168,385 B2
(45) Date of Patent: Nov. 9, 2021

(54) HIGH-ENTROPY ALCRTIV ALLOYS

(71) Applicant: Ohio State Innovation Foundation, Columbus, OH (US)

(72) Inventors: Aihua Luo, Columbus, OH (US); Weihua Sun, Columbus, OH (US); Xuejun Huang, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 418 days.

(21) Appl. No.: 15/800,668

(22) Filed: Nov. 1, 2017

(65) Prior Publication Data

US 2018/0119255 A1 May 3, 2018

Related U.S. Application Data

(60) Provisional application No. 62/415,691, filed on Nov. 1, 2016, provisional application No. 62/423,018, filed on Nov. 16, 2016.

(51) Int. Cl.

| | |
|---|---|
| ***C22C 30/00*** | (2006.01) |
| ***C22C 27/02*** | (2006.01) |
| ***C22C 27/06*** | (2006.01) |
| *C22C 33/04* | (2006.01) |

(52) U.S. Cl.

CPC ..... *C22C 30/00* (2013.01); *C22C 27/025* (2013.01); *C22C 27/06* (2013.01); *C22C 33/04* (2013.01)

(58) Field of Classification Search

CPC ..... C22C 27/025; C22C 27/06; C22C 30/00; C22C 33/04

USPC ..... 420/588

See application file for complete search history.

(56) References Cited

U.S. PATENT DOCUMENTS

| | | | |
|---|---|---|---|
| 3,084,042 | A | 4/1963 | Wartel et al. |
| 4,194,900 | A | 3/1980 | Ide et al. |
| 4,822,414 | A | 4/1989 | Yoshikawa et al. |
| 5,358,584 | A | 10/1994 | Bendersky |
| 6,177,046 | B1 | 1/2001 | Simkovich et al. |
| 6,319,340 | B1 | 11/2001 | Takeuchi et al. |
| 9,150,945 | B2 | 10/2015 | Bei |

(Continued)

FOREIGN PATENT DOCUMENTS

| | | | |
|---|---|---|---|
| CN | 103194656 | A | 7/2013 |
| CN | 103194657 | A1 | 7/2013 |
| CN | 105925869 | A * | 9/2016 |

OTHER PUBLICATIONS

NPL-1: Wang et al, Thermodynamic assessment of ordered B2 Phase in the Ti—V—Cr—Al quaternary system, CALPHAD: Computer coupling of phase diagrams and thermochemistry 35 (2011) 204-208. (Year: 2011).*

(Continued)

*Primary Examiner* — Jie Yang

(74) *Attorney, Agent, or Firm* — McDonnell Boehnen Hulbert & Berghoff LLP

(57) ABSTRACT

The present disclosure relates to relates generally to metal alloys. The present disclosure relates more particularly to High Entropy Alloys having relatively high strength and relatively low weight. In one aspect, the present disclosure provides a multiple-principal-element high-entropy AlCrTiV metal alloy comprising Al in an amount of 5-50 at %; Cr in an amount of 5-50 at %; Ti in an amount of 5-60 at %; and V in an amount of 5-50 at %, wherein the total amount of Al, Cr, Ti and V is at least 80 at %.

18 Claims, 12 Drawing Sheets

(56) References Cited

U.S. PATENT DOCUMENTS

| | | | | |
|---|---|---|---|---|
| 2001/0022946 | A1 | 9/2001 | Tetsui et al. | |
| 2002/0159914 | A1 | 10/2002 | Yeh | |
| 2003/0148145 | A1 | 8/2003 | Yamamoto et al. | |
| 2004/0037733 | A1 | 2/2004 | Oka | |
| 2004/0134308 | A1 | 7/2004 | Takata et al. | |
| 2005/0244668 | A1 | 11/2005 | Narita et al. | |
| 2009/0035175 | A1 | 2/2009 | Takenawa et al. | |
| 2010/0015003 | A1 | 1/2010 | Adam et al. | |
| 2016/0326616 | A1* | 11/2016 | Park | C22C 21/00 |

OTHER PUBLICATIONS

NPL: CN-105925869-A on-line translation, Sep. 2016 (Year: 2016).*

J.W. Yeh, S.K. Chen, S.J. Lin, J.Y. Gan, T.S. Chin, T.T. Shun, C.H. Tsau, S.Y. Chang, "Nanostructured high-entropy alloys with multiple principal elements: novel alloy design concepts and outcomes," Adv. Eng. Mater. 6, 1527-2648 (2004).

J.W. Yeh, S.J. Lin, T.S. Chin, J.Y. Gan, S.K. Chen, T.T. Shun, C.H. Tsau, S.Y. Chang, "Formation of simple crystal structures in Cu—Co—Ni—Cr—Al—Fe—Ti—V alloys with multiprincipal metallic elements," Metall. Mater. Trans. A 35, 2533-2536 (2004).

N.D. Stepanov, D.G. Shaysutanov, G.A. Salishchev, M.A. Tikhonovsky, "Structure and mechanical properties of a light-weight AlNbTiV high entropy alloy," Mater. Lett. 142, 153-155 (2015).

N.D. Stepanov, N.Y. Yurchenko, D.G. Shaysutanov, G.A. Salishchev, M.A. Tikhonovsky, "Effect of Al on structure and mechanical properties of AlxNbTiVZr (x=0, 0.5, 1, 1.5) high entropy alloys," Mater. Sci. Technol. 31,1184-1193 (2015).

O.N. Senkov, J.D. Miller, D.B. Miracle, C. Woodward, "Accelerated exploration of multi-principal element alloys with solid solution phases," Nat. Commun. 6, 6529 (2014).

B. Gorr, M. Azim, H.J. Christ, H. Chen, D.V. Szabo, A. Kauffmann, M. Heilmaier, "Microstructure Evolution in a New Refractory High-Entropy Alloy W—Mo—Cr—Ti—Al, Metall. Mater. Trans. A," 47, 961-970 (2014).

C. Huang, Y. Zhang, R. Vilar, "Microstructure characterization of laser clad TiVCrAlSi high entropy alloy coating on Ti—6Al—4V substrate," Adv. Mater. Res. 154-155, 621-625 (2011).

S. Varalakshmi, M. Kamaraj, B.S. Murty, "Synthesis and characterization of nanocrystalline AlFeTiCrZnCu high entropy solid solution by mechanical alloying," J. Alloys Compd. 460, 253-257 (2008).

C.M. Liu, H.M. Wang, S.Q. Zhang, H.B. Tang, A.L. Zhang, "Microstructure and oxidation behaviour of new refractory high entropy alloys," J. Alloys Compd, 583, 162-169 (2014).

Y.J. Zhou, Y. Zhang, Y.L. Wang, G.L. Chen, "Microstructure and compressive properties of multicomponent Alx(TiVCrMnFeCoNiCu)100-x high-entropy alloys," Mater. Sci. Eng. A 454-455, 260-265 (2007).

Y. Zhang, Y. Zhou, X. Hui, M. Wang, G. Chen, "Minor alloying behaviour in bulk metallic glasses and high-entropy alloys," Sci. China, Ser. G 51, 427-437 (2008).

* cited by examiner 0.5 at.%

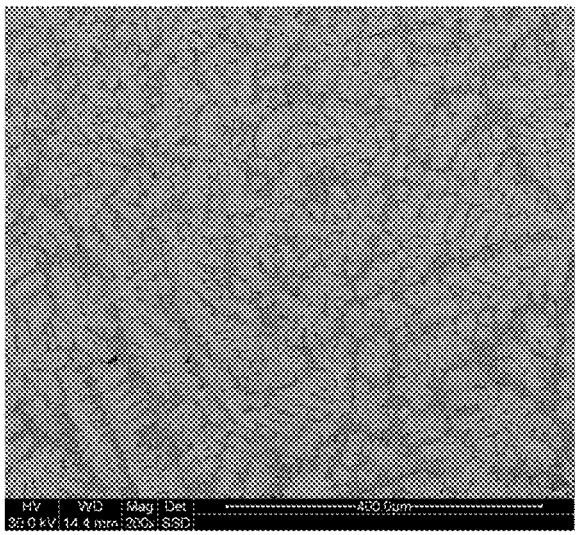
1.5 at.% FIG. 21
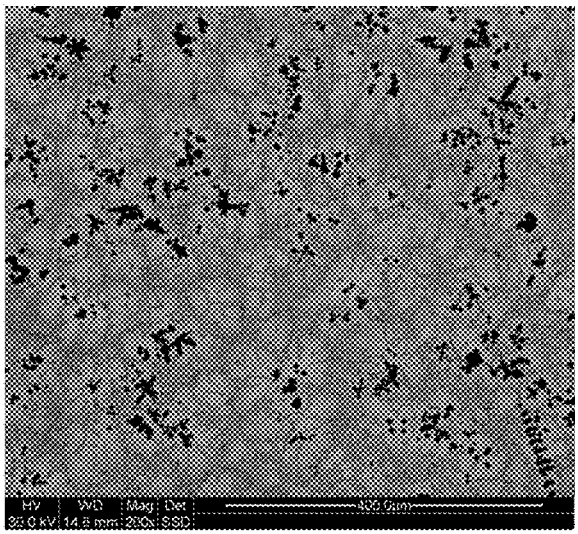
5 at.% FIG. 22

HIGH-ENTROPY ALCRTIV ALLOYS

CROSS-REFERENCE TO RELATED APPLICATIONS

This application claims the benefit of priority under 35 U.S.C. § 119(e) of U.S. Patent Application No. 62/415,691, filed Nov. 1, 2016, and U.S. Provisional Patent Application No. 62/423,018, filed Nov. 16, 2016, each of which is hereby incorporated herein by reference in its entirety.

BACKGROUND OF THE DISCLOSURE

1. Field of the Disclosure

The present disclosure relates generally to metal alloys. The present disclosure relates more particularly to High Entropy Alloys having relatively high strength and relatively low weight.

2. Technical Background

High Entropy Alloys is a new class of multiple-principal-element alloys stabilized by large configurational entropy. Unlike conventional alloys based on a single principal element with relatively small amounts of alloying elements, High Entropy Alloys typically have four, five or even more principal elements, all in relatively high amounts. High Entropy Alloys can offer exceptional mechanical, chemical and magnetic properties at room and elevated temperatures. Primarily due to the high entropy effect, the microstructure of a High Entropy Alloy usually exhibits a single solid solution phase having a body-centered cubic (BCC) structure, a face-centered cubic (FCC) structure, a hexagonal closed-packed (HCP), or a mixture of two or more thereof. Often, there is a predominant solution phase (e.g., with a structure as described above), with a minor amount of one or more intermetallics. Current efforts in the High Entropy Alloy field have been mostly focused on developing new materials with exceptional mechanical properties. Since High Entropy Alloys often consist of 4 or more principal elements, they typically contain elements with high densities, such as Fe, Co, Ni. However, such high density elements can cause the overall alloy to be relatively heavy, which can There are, of course, alloys with lighter weight, such as certain Ti—Al—V alloys and stainless steel, such as 304 Stainless Steel. While these can be light, they often sacrifice one or more other desirable properties, such as high strength and/or high hardness.

There remains a need for new metal alloys that have an overall desirable set of mechanical properties while maintaining relatively low weight.

SUMMARY OF THE DISCLOSURE

In one aspect, the present disclosure provides a multiple-principal-element high-entropy AlCrTiV metal alloy comprising Al in an amount of 5-50 at %;
Cr in an amount of 5-50 at %;
Ti in an amount of 5-60 at %; and
V in an amount of 5-50 at %,
wherein the total amount of Al, Cr, Ti and V is at least 80 at %.

In another aspect, the present disclosure provides a multiple-principal-element high-entropy AlCrTiV metal alloy comprising Al in an amount of 15-35 at %;
Cr in an amount of 15-35 at %;
Ti in an amount of 15-35 at %; and
V in an amount of 15-35 at %,
wherein the total amount of Al, Cr, Ti and V is at least 80 at %.

In one aspect, the present disclosure provides a multiple-principal-element high-entropy AlCrTiV metal alloy comprising Al in an amount of 15-35 at %;
Cr in an amount of 5-20 at %;
Ti in an amount of 30-45 at %; and
V in an amount of 15-35 at %,
wherein the total amount of Al, Cr, Ti and V is at least 80 at %.

In one aspect, the present disclosure provides a multiple-principal-element high-entropy AlCrTiV metal alloy comprising Al in an amount of 5-25 at %;
Cr in an amount of 15-35 at %;
Ti in an amount of 35-55 at %; and
V in an amount of 5-25 at %,
wherein the total amount of Al, Cr, Ti and V is at least 80 at %.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

FIGS. 20-22 are micrographs showing the microstructure of materials including carbon at nominal 0.5 at %, 1.5 at % and 5 at % carbon.

DETAILED DESCRIPTION

Figure 1:
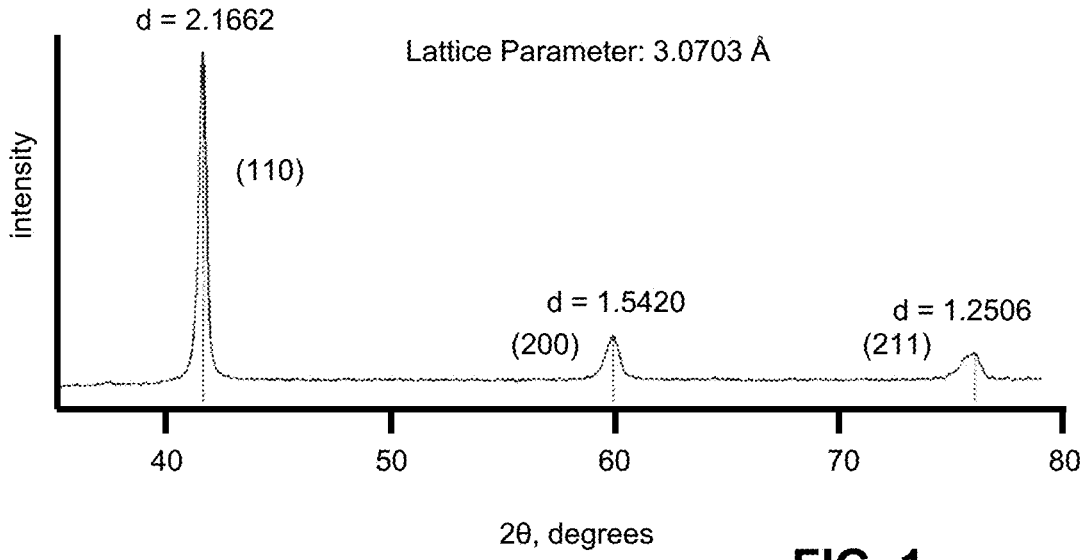
FIG. 1 is an X-ray diffraction pattern of the material of Example 1.

The inventors have noted that it is possible to reduce the density (and, thus, the weight) of an alloy, by increasing the content of lighter elements. But it is desirable to do this in a way that maintains the desirable mechanical properties of the alloy. For example, the Al in the classical AlCoCrFeNi system is a lighter element that reduces weight yet allows desirable mechanical properties to be maintained. The present inventors have noted that in doing so, it is possible to add more than one light element, such as Al, Ti or Mg. The present inventors have noted that the particular multiple-principal element high-entropy AlCrTiV metal alloys described herein have a number of advantages. Notably, in certain aspects of the disclosure, the alloys can be made with extremely high hardness values, making them attractive for use as high-strength structural materials. And because they include substantial amounts of aluminum and titanium, they can have relatively low densities. Accordingly, the presently described materials can in many aspects provide both high strength and low weight.

Accordingly, one aspect of the disclosure is a multicomponent high-entropy metal alloy that includes aluminum (Al) in an amount of 5-50 at %, chromium (Cr) in an amount in the range of 5-50 at %, titanium (Ti) in an amount of 5-60 at %, and vanadium (V) in an amount in the range of 5-50 at %. The total amount of Al, Cr, Ti and V is at least 80 at %.

The amount of aluminum can be varied within the above-noted range of 5-50 at %. The person of ordinary skill in the art will, based on the disclosure herein, select an appropriate amount of aluminum for a particular alloy material. For example, in certain embodiments of the alloys as otherwise described herein, Al is present in an amount of 10-50 at %. In other embodiments of the alloys as otherwise described herein, Al is present in an amount of 15-50 at %. In other embodiments of the alloys as otherwise described herein, Al is present in an amount of 20-50 at %. In other embodiments of the alloys as otherwise described herein, Al is present in an amount of 27-50 at %. In other embodiments of the alloys as otherwise described herein, Al is present in an amount of 27-43 at %. In other embodiments of the alloys as otherwise described herein, Al is present in an amount of 5-40 at %. In other embodiments of the alloys as otherwise described herein, Al is present in an amount of 5-30 at %. In other embodiments of the alloys as otherwise described herein, Al is present in an amount of 10-40 at %. In other embodiments of the alloys as otherwise described herein, Al is present in an amount of 5-25 at %. In other embodiments of the alloys as otherwise described herein, Al is present in an amount of 10-20 at %. Aluminum has a relatively low density (~2.7 g/cm$^3$), and so increasing amounts of aluminum will tend to decrease the overall density of the material. Increasing amounts of aluminum can, however, decrease the hardness and strength of the material.

The amount of chromium can be varied within the above-noted range of 5-60 at %. The person of ordinary skill in the art will, based on the disclosure herein, select an appropriate amount of chromium for a particular alloy material. For example, in certain embodiments of the alloys as otherwise described herein, Cr is present in an amount of 10-50 at %. In other embodiments of the alloys as otherwise described herein, Cr is present in an amount of 15-50 at %. In other embodiments of the alloys as otherwise described herein, Cr is present in an amount of 20-50 at %. In other embodiments of the alloys as otherwise described herein, Cr is present in an amount of 27-50 at %. In other embodiments of the alloys as otherwise described herein, Cr is present in an amount of 27-43 at %. In other embodiments of the alloys as otherwise described herein, Cr is present in an amount of 5-40 at %. In other embodiments of the alloys as otherwise described herein, Cr is present in an amount of 5-30 at %. In other embodiments of the alloys as otherwise described herein, Cr is present in an amount of 10-40 at %. In other embodiments of the alloys as otherwise described herein, Cr is present in an amount of 15-35 at %. In other embodiments of the alloys as otherwise described herein, Cr is present in an amount of 20-30 at %. Chromium has a relatively high density (~7.1 g/cm$^3$), and so increasing amounts of chromium will tend to increase the overall density of the material. But increasing amounts of chromium can help to improve hardness and strength of the material, and may also improve high-temperature mechanical properties and corrosion resistance of the material.

The amount of titanium can be varied within the above-noted range of 5-50 at %. The person of ordinary skill in the art will, based on the disclosure herein, select an appropriate amount of titanium for a particular alloy material. For example, in certain embodiments of the alloys as otherwise described herein, Ti is present in an amount of 10-50 at %. In other embodiments of the alloys as otherwise described herein, Ti is present in an amount of 15-50 at %. In other embodiments of the alloys as otherwise described herein, Ti is present in an amount of 20-50 at %. In other embodiments of the alloys as otherwise described herein, Ti is present in an amount of 27-50 at %. In other embodiments of the alloys as otherwise described herein, Ti is present in an amount of 27-43 at %. In other embodiments of the alloys as otherwise described herein, Ti is present in an amount of 5-40 at %. In other embodiments of the alloys as otherwise described herein, Ti is present in an amount of 5-30 at %. In other embodiments of the alloys as otherwise described herein, Ti is present in an amount of 10-40 at %. In other embodiments of the alloys as otherwise described herein, Ti is present in an amount of 35-55 at %. In other embodiments of the alloys as otherwise described herein, Ti is present in an amount of 40-50 at %. Titanium has a relatively low density (~4.5 g/cm$^3$), and so increasing amounts of titanium will tend to decrease the overall density of the material. Increasing amounts of titanium can help to improve strength and toughness of the material, and may also improve high-temperature mechanical properties and corrosion resistance of the material.

The amount of vanadium can be varied within the above-noted range of 5-50 at %. The person of ordinary skill in the art will, based on the disclosure herein, select an appropriate amount of vanadium for a particular alloy material. For example, in certain embodiments of the alloys as otherwise described herein, V is present in an amount of 10-50 at %. In other embodiments of the alloys as otherwise described herein, V is present in an amount of 15-50 at %. In other embodiments of the alloys as otherwise described herein, V is present in an amount of 20-50 at %. In other embodiments of the alloys as otherwise described herein, V is present in an amount of 27-50 at %. In other embodiments of the alloys as otherwise described herein, V is present in an amount of 27-43 at %. In other embodiments of the alloys as otherwise described herein, V is present in an amount of 5-40 at %. In other embodiments of the alloys as otherwise described herein, V is present in an amount of 5-30 at %. In other embodiments of the alloys as otherwise described herein, V is present in an amount of 5-25 at %. In other embodiments of the alloys as otherwise described herein, V is present in an amount of 10-20 at %. In other embodiments of the alloys as otherwise described herein, V is present in an amount of 10-40 at %. Vanadium has an intermediate density (~6.1 g/cm$^3$), and so increasing amounts of vanadium may tend to increase the overall density of a low-density material. Increasing amounts of vanadium can help to improve strength and toughness of the material, and may also improve high-temperature mechanical properties and corrosion resistance of the material.

In certain embodiments of the alloys as otherwise described herein, Al is present in an amount of 10-50 at %; Cr is present in an amount of 10-50 at %; Ti is present in an amount of 10-50 at %; and V is present in an amount of 10-50 at %.

In other embodiments of the alloys as otherwise described herein, Al is present in an amount of 15-50 at %; Cr is present in an amount of 15-50 at %; Ti is present in an amount of 15-50 at %; and V is present in an amount of 15-50 at %.

In other embodiments of the alloys as otherwise described herein, Al is present in an amount of 10-45 at %; Cr is present in an amount of 10-45 at %; Ti is present in an amount of 10-45 at %; and V is present in an amount of 10-45 at %.

Other embodiments of the alloys as otherwise described herein are provided in the table below, described with respect to the amounts of Al, Cr, Ti and V.

| Embodiment | Al (at %) | Cr (at %) | Ti (at %) | V (at %) |
|---|---|---|---|---|
| A | 15-35 | 15-35 | 15-35 | 15-35 |
| B | 15-35 | 10-30 | 20-40 | 15-35 |
| C | 15-35 | 5-20 | 30-45 | 15-35 |
| E | 20-40 | 20-40 | 20-40 | 20-40 |
| F | 20-40 | 10-30 | 20-40 | 20-40 |
| G | 20-40 | 5-20 | 30-45 | 20-40 |
| H | 20-30 | 20-30 | 20-30 | 20-30 |
| I | 20-30 | 15-25 | 25-35 | 20-30 |
| J | 20-30 | 7-18 | 32-43 | 20-30 |
| K | 5-25 | 15-35 | 35-55 | 5-25 |
| L | 10-20 | 20-30 | 40-50 | 10-20 |

As noted above, while other components may be present in the alloys of the present disclosure, the total amount of Al, Cr, Ti and V is at least 80 at %. In certain embodiments of the alloys as otherwise described herein, the total amount of Al, Cr, Ti and V is at least 85 at %. In other embodiments of the alloys as otherwise described herein, the total amount of Al, Cr, Ti and V is at least 90 at %. In certain embodiments of the alloys as otherwise described herein, the total amount of Al, Cr, Ti and V is at least 95 at %. Notably, the present inventors have determined that useful alloys may be made without the presence of large amounts of other components. (Of course, as described in further detail below, in certain embodiments there are additional components included in the alloy, e.g., in relatively small amounts.)

In certain embodiments, an alloy as otherwise described herein further includes silicon (Si), e.g., in an amount up to 15 at %. For example, in certain embodiments, Si is present in the alloy in an amount up to 10 at %, up to 7 at %, up to 5 at %, up to 4 at %, up to 3 at %, in the range of 0.5-15 at %, in the range of 0.5-10 at %, in the range of 0.5-7 at %, in the range of 0.5-5 at %, in the range of 0.5-4 at % or in the range of 0.5-3 at %. As described below, a small amount of silicon can improve hardness. Without being bound by any particular theory, the inventors surmise that the increased hardness is related to both the formation of metal silicide intermetallic and solid solution strengthening of the matrix by silicon. However, in certain alternative embodiments, the alloy is substantially free of silicon, e.g., having less than 0.1 at %, less than 0.05 at %, or even less than 0.01 at % Si. The present inventors have determined that while silicon can improve hardness, suitably hard alloys can be made even without the use of silicon.

In certain embodiments, an alloy as otherwise described herein further includes carbon (C), e.g., in an amount up to 15 at %. For example, in certain embodiments, C is present in the alloy in an amount up to 10 at %, up to 7 at %, up to 5 at %, up to 4 at %, up to 3 at %, in the range of 0.5-15 at %, in the range of 0.5-10 at %, in the range of 0.5-7 at %, in the range of 0.5-5 at %, in the range of 0.5-4 at % or in the range of 0.5-3 at %. Similar to silicon, a small amount of carbon can improve hardness. Without being bound by any particular theory, the inventors surmise that the increased hardness is related to both the formation of metal carbide intermetallic and solid solution strengthening of the matrix by carbon. However, in certain alternative embodiments, the alloy is substantially free of carbon, e.g., having less than 0.1 at %, less than 0.05 at %, or even less than 0.01 at % C. The present inventors have noted that while carbon can improve hardness, suitably hard alloys can be made even without the use of carbon.

In certain embodiments, an alloy as otherwise described herein further includes boron (B), e.g., in an amount up to 15 at %. For example, in certain embodiments, B is present in the alloy in an amount up to 10 at %, up to 7 at %, up to 5 at %, up to 4 at %, up to 3 at %, in the range of 0.5-15 at %, in the range of 0.5-10 at %, in the range of 0.5-7 at %, in the range of 0.5-5 at %, in the range of 0.5-4 at % or in the range of 0.5-3 at %. Similar to silicon, a small amount of boron can improve hardness. Without being bound by any particular theory, the inventors surmise that the increased hardness is related to both the formation of metal boride intermetallic and solid solution strengthening of the matrix by boron. However, in certain alternative embodiments, the alloy is substantially free of boron, e.g., having less than 0.1 at %, less than 0.05 at %, or even less than 0.01 at % B. The present inventors have noted that while carbon can improve hardness, suitably hard alloys can be made even without the use of boron.

The alloys described herein can include a variety of additional components. For example, in certain embodiments, an alloy as otherwise described herein includes one or more additional metallic components selected from Mo, W, Nb, Ta, Hf, Zr, Co, Ni, Fe, Pd, Re, Y, Sc, Rh, Be, Mg, Cu, Zn, Ru, Ag, Au, Pt, La, Ce, Pr, Nd, Sm, Eu, Gd, Tb, Na, Li, Ga, Ge, Sr, Sn, Cd and In.

In certain particular embodiments, an alloy as otherwise described herein includes one or more additional metallic components selected from Mo, W, Nb, Zr, Co, Ni, Fe, Y, Sc, Be, Mg, Cu, Zn, Li, Ge and Sr. In certain such embodiments, the alloy is substantially free of other metallic components (e.g., less than 0.5 at %, or even less than 0.1 at % of other metallic components).

In certain particular embodiments, an alloy as otherwise described herein includes one or more additional metallic components selected from W, Mo, Nb, Zr, Be and Li. In certain such embodiments, the alloy is substantially free of other metallic components (e.g., less than 0.5 at %, or even less than 0.1 at % of other metallic components).

In certain embodiments, an alloy as otherwise described herein further includes Mo, for example, in an amount up to 20 at % (e.g., 0.5-20 at %), in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Mo, e.g., having less than 0.5 at %, less than 0.1 at %, less than 0.05 at %, or even less than 0.01 at % Mo. The present inventors have noted suitable alloys can be made even without the use of Mo.

In certain embodiments, an alloy as otherwise described herein further includes W, for example, in an amount up to 20 at % (e.g., 0.5-20 at %), in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of W, e.g., having less than 0.5 at %, less than 0.1 at %, less than 0.05 at %, or even less than 0.01 at % W. The present inventors have noted suitable alloys can be made even without the use of W.

In certain embodiments, an alloy as otherwise described herein further includes Nb, for example, in an amount up to 20 at % (e.g., 0.5-20 at %), in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Nb, e.g., having less than 0.5 at %, less than 0.1 at %, less than 0.05 at %, or even less than 0.01 at % Nb. The present inventors have noted suitable alloys can be made even without the use of Nb.

In certain embodiments, an alloy as otherwise described herein further includes Ta, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Ta, e.g., having less than 0.5 at %, less than 0.1 at %, less than 0.05 at %, or even less than 0.01 at % Ta. The present inventors have noted suitable alloys can be made even without the use of Ta.

In certain embodiments, an alloy as otherwise described herein further includes Hf, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Hf, e.g., having less than 0.5 at %, less than 0.1 at %, less than 0.05 at %, or even less than 0.01 at % Hf. The present inventors have noted suitable alloys can be made even without the use of Hf.

In certain embodiments, an alloy as otherwise described herein further includes Zr, for example, in an amount up to 20 at % (e.g., 0.5-20 at %), in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Zr, e.g., having less than 0.5 at %, less than 0.1 at %, less than 0.05 at %, or even less than 0.01 at % Zr. The present inventors have noted suitable alloys can be made even without the use of Zr.

In certain embodiments, an alloy as otherwise described herein further includes Co, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Co, e.g., having less than 0.5 at %, less than 0.1 at %, less than 0.05 at %, or even less than 0.01 at % Co. The present inventors have noted suitable alloys can be made even without the use of Co.

In certain embodiments, an alloy as otherwise described herein further includes Ni, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Ni, e.g., having less than 0.5 at %, less than 0.1 at %, less than 0.05 at %, or even less than 0.01 at % Ni. The present inventors have noted suitable alloys can be made even without the use of Ni.

In certain embodiments, an alloy as otherwise described herein further includes Fe, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Fe, e.g., having less than 0.5 at %, less than 0.1 at %, less than 0.05 at %, or even less than 0.01 at % Fe. The present inventors have noted suitable alloys can be made even without the use of Fe.

In certain embodiments, an alloy as otherwise described herein further includes Pd, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Pd, e.g., having less than 0.5 at %, less than 0.1 at %, less than 0.05 at %, or even less than 0.01 at % Pd. The present inventors have noted suitable alloys can be made even without the use of Pd.

In certain embodiments, an alloy as otherwise described herein further includes Re, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Re, e.g., having less than 0.5 at %, less than 0.1 at %, less than 0.05 at %, or even less than 0.01 at % Re. The present inventors have noted suitable alloys can be made even without the use of Re.

In certain embodiments, an alloy as otherwise described herein further includes Y, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Y, e.g., having less than 0.5 at %, less than 0.1 at %, less than 0.05 at %, or even less than 0.01 at % Y. The present inventors have noted suitable alloys can be made even without the use of Y.

In certain embodiments, an alloy as otherwise described herein further includes Sc, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Sc, e.g., having less than 0.5 at %, less than 0.1 at %, less than 0.05 at %, or even less than 0.01 at % Sc. The present inventors have noted suitable alloys can be made even without the use of Sc.

In certain embodiments, an alloy as otherwise described herein further includes Rh, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Rh, e.g., having less than 0.5 at %, less than 0.1 at %, less than 0.05 at %, or even less than 0.01 at % Rh. The present inventors have noted suitable alloys can be made even without the use of Rh.

In certain embodiments, an alloy as otherwise described herein further includes Be, for example, in an amount up to 20 at % (e.g., 0.5-20 at %), in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Be, e.g., having less than 0.5 at %, less than 0.1 at %, less than 0.05 at %, or even less than 0.01 at % Be. The present inventors have noted suitable alloys can be made even without the use of Be.

In certain embodiments, an alloy as otherwise described herein further includes Mg, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Mg, e.g., having less than 0.5 at %, less than 0.1 at %, less than 0.05 at %, or even less than 0.01 at % Mg. The present inventors have noted suitable alloys can be made even without the use of Mg.

In certain embodiments, an alloy as otherwise described herein further includes Cu, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Cu, e.g., having less than 0.5 at %, less than 0.1 at %, less than 0.05 at %, or even less than 0.01 at % Cu. The present inventors have noted suitable alloys can be made even without the use of Cu.

In certain embodiments, an alloy as otherwise described herein further includes Zn, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Zn, e.g., having less than 0.5 at %, less than 0.1 at %, less than 0.05 at %, or even less than 0.01 at % Zn. The present inventors have noted suitable alloys can be made even without the use of Zn.

In certain embodiments, an alloy as otherwise described herein further includes Ru, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Ru, e.g., having less than 0.5 at %, less than 0.1 at %, less than 0.05 at %, or even less than 0.01 at % Ru. The present inventors have noted suitable alloys can be made even without the use of Ru.

In certain embodiments, an alloy as otherwise described herein further includes Ag, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Ag, e.g., having less than 0.5 at %, less than 0.1 at %, less than 0.05 at %, or even less than 0.01 at % Ag. The present inventors have noted suitable alloys can be made even without the use of Ag.

In certain embodiments, an alloy as otherwise described herein further includes Au, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Au, e.g., having less than 0.5 at %, less than 0.1 at %, less than 0.05 at %, or even less than 0.01 at % Au. The present inventors have noted suitable alloys can be made even without the use of Au.

In certain embodiments, an alloy as otherwise described herein further includes Pt, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Pt, e.g., having less than 0.5 at %, less than 0.1 at %, less than 0.05 at %, or even less than 0.01 at % Pt. The present inventors have noted suitable alloys can be made even without the use of Pt.

In certain embodiments, an alloy as otherwise described herein further includes La, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of La, e.g., having less than 0.5 at %, less than 0.1 at %, less than 0.05 at %, or even less than 0.01 at % La. The present inventors have noted suitable alloys can be made even without the use of La.

In certain embodiments, an alloy as otherwise described herein further includes Ce, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Ce, e.g., having less than 0.5 at %, less than 0.1 at %, less than 0.05 at %, or even less than 0.01 at % Ce. The present inventors have noted suitable alloys can be made even without the use of Ce.

In certain embodiments, an alloy as otherwise described herein further includes Pr, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Pr, e.g., having less than 0.5 at %, less than 0.1 at %, less than 0.05 at %, or even less than 0.01 at % Pr. The present inventors have noted suitable alloys can be made even without the use of Pr.

In certain embodiments, an alloy as otherwise described herein further includes Nd, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Nd, e.g., having less than 0.5 at %, less than 0.1 at %, less than 0.05 at %, or even less than 0.01 at % Nd. The present inventors have noted suitable alloys can be made even without the use of Nd.

In certain embodiments, an alloy as otherwise described herein further includes Sm, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Sm, e.g., having less than 0.5 at %, less than 0.1 at %, less than 0.05 at %, or even less than 0.01 at % Sm. The present inventors have noted suitable alloys can be made even without the use of Sm.

In certain embodiments, an alloy as otherwise described herein further includes Eu, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Eu, e.g., having less than 0.5 at %, less than 0.1 at %, less than 0.05 at %, or even less than 0.01 at % Eu. The present inventors have noted suitable alloys can be made even without the use of Eu.

In certain embodiments, an alloy as otherwise described herein further includes Gd, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Gd, e.g., having less than 0.5 at %, less than 0.1 at %, less than 0.05 at %, or even less than 0.01 at % Gd. The present inventors have noted suitable alloys can be made even without the use of Gd.

In certain embodiments, an alloy as otherwise described herein further includes Tb, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Tb, e.g., having less than 0.5 at %, less than 0.1 at %, less than 0.05 at %, or even less than 0.01 at % Tb. The present inventors have noted suitable alloys can be made even without the use of Tb.

In certain embodiments, an alloy as otherwise described herein further includes Na, for example, in an amount up to 10 at % (e.g., 0.5-10 at %), up to 5 at % (e.g., 0.5-5 at %), or in an amount up to 2 at % (e.g., 0.5-2 at %). But in certain embodiments, an alloy as otherwise described herein is substantially free of Na, e.g., having less than 0.5 at %, less than 0.1 at %, less than 0.05 at %, or even less than 0.01 at % Na. The present inventors have noted suitable alloys can be made even without the use of Na.

In certain embodiments, an alloy as otherwise described herein further includes Li, for example, in an amount up to 20 at % (e.g., 0.5-20 at %), in an amount up to 10 at % (e.g., 0.5-10 at %), up to 5 at % (e.g., 0.5-5 at %), or in an amount up to 2 at % (e.g., 0.5-2 at %). But in certain embodiments, an alloy as otherwise described herein is substantially free of Li, e.g., having less than 0.5 at %, less than 0.1 at %, less than 0.05 at %, or even less than 0.01 at % Li. The present inventors have noted suitable alloys can be made even without the use of Li.

In certain embodiments, an alloy as otherwise described herein further includes Ga, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Ga, e.g., having less than 0.5 at %, less than 0.1 at %, less than 0.05 at %, or even less than 0.01 at % Ga. The present inventors have noted suitable alloys can be made even without the use of Ga.

In certain embodiments, an alloy as otherwise described herein further includes Ge, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Ge, e.g., having less than 0.5 at %, less than 0.1 at %, less than 0.05 at %, or even less than 0.01 at % Ge. The present inventors have noted suitable alloys can be made even without the use of Ge.

In certain embodiments, an alloy as otherwise described herein further includes Sr, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Sr, e.g., having less than 0.5 at %, less than 0.1 at %, less than 0.05 at %, or even less than 0.01 at % Sr. The present inventors have noted suitable alloys can be made even without the use of Sr.

In certain embodiments, an alloy as otherwise described herein further includes Sn, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Sn, e.g., having less than 0.5 at %, less than 0.1 at %, less than 0.05 at %, or even less than 0.01 at % Sn. The present inventors have noted suitable alloys can be made even without the use of Sn.

In certain embodiments, an alloy as otherwise described herein further includes Cd, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of Cd, e.g., having less than 0.5 at %, less than 0.1 at %, less than 0.05 at %, or even less than 0.01 at % Cd. The present inventors have noted suitable alloys can be made even without the use of Cd.

In certain embodiments, an alloy as otherwise described herein further includes In, for example, in an amount up to 10 at % (e.g., 0.5-10 at %), in an amount up to 5 at % (e.g., 0.5-5 at %), or in an amount up to 2 at % (e.g., 0.5-2 at %). But in certain embodiments, an alloy as otherwise described herein is substantially free of In, e.g., having less than 0.5 at %, less than 0.1 at %, less than 0.05 at %, or even less than 0.01 at % In. The present inventors have noted suitable alloys can be made even without the use of In.

However, while additional components can in certain embodiments be included in the alloy, in certain embodiments of the alloys as otherwise described herein, no single elemental component other than the Al, the Cr, the Ti or the V is present in an amount in excess of 15 at %. For example, in certain embodiments of the alloys as otherwise described herein, no single elemental component other than the Al, the Cr, the Ti or the V is present in an amount in excess of 10 at %. In certain particular embodiments of the alloys as otherwise described herein, no single elemental component other than the Al, the Cr, the Ti or the V is present in an amount in excess of 5 at %.

In certain desirable embodiments, an alloy as otherwise described herein has a low content of oxygen, sulfur, boron, nitrogen and/or phosphorus. For example, in certain embodiments, an alloy as otherwise described herein has no more than 3 at %, no more than 1 at %, no more than 0.5 at %, no more than 0.1 at %, or even no more than 0.05 at % 0.

The alloys described herein can have a variety of morphologies. Advantageously, the alloys described herein are so-called "high-entropy" alloys as a result of having four different metal components (i.e., Al, Cr, Ti, V) in substantial amounts as described. In certain desirable embodiments, an alloy as described herein has substantially a single solid solution phase. For example, an alloy as described herein can be at least 80 vol %, at least 90 vol %, at least 95 vol % or even at least 98 vol % in a single solid solution phase. That single solid solution phase can be, for example, a an ordered or partially-ordered body-centered cubic phase.

In certain alternative embodiments, an alloy as otherwise described herein is in a plurality of phases. For example, when certain additional components such as silicon are present in the alloy, intermetallic compounds (e.g., Si-rich intermetallics such as $Ti_5Si_3$) can form a substantially separate phase. In certain such embodiments, at least 30 vol %, at least 50 vol %, or even at least 75 vol % of the alloy is in an ordered or partially-ordered body-centered cubic phase.

As noted above, the alloys described herein can be made to have a high hardness. For example, in certain embodiments, an alloy as otherwise described herein has a Vickers hardness of at least 500, for example, in the range of 500-1200, in the range of 500-1000, or in the range of 500-900. In certain embodiments, an alloy as otherwise described herein has a Vickers hardness of at least 550, for example, in the range of 550-1200, in the range of 550-1000, or in the range of 550-900. In certain embodiments, an alloy as otherwise described herein has a Vickers hardness of at least 600, for example, in the range of 600-1200, in the range of 600-1000, or in the range of 600-900. Vickers hardness is measured using a Vickers hardness tester, with a load of 200 g and a loading time of 15 s. The sample is prepared by sequential grinding with 180, 320, 400, 600, 800 and 1200 grit grinding papers.

Also as noted above, the alloys described herein can be made to have relatively low density, and thus to provide lightweight yet strong materials. In certain embodiments, an alloy as otherwise described herein has a density of no more than 6 g/cm$^3$, for example, no more than 5.5 g/cm$^3$ or no more than 5 g/cm$^3$. In certain embodiments, an alloy as otherwise described herein has a density in the range of 3-6 g/cm$^3$, or 4-6 g/cm$^3$, or 5-6 g/cm$^3$, or 3-5 g/cm$^3$, or 4-5 g/cm$^3$.

The alloys described herein can be prepared in a variety of manners. Advantageously, the alloys described here can be prepared by melting and casting processes familiar to the person of ordinary skill in the art. The inventors have determined that in certain embodiments the alloys described herein can form solid solutions, for example, in an ordered or partially ordered body-centered cubic phase by direct cooling from a melt. A number of synthetic methods can be used to make the alloys as described herein, for example, arc melting, induction melting, rapid solidification, mechanical alloying, powder metallurgy. Conventional annealing techniques can be used to further improve material properties.

The alloys of the present disclosure are described further with respect to the following Examples.

EXAMPLES

Four Example compositions were prepared, having the nominal compositions shown below:

| Example | Al (at %) | Cr (at %) | Ti (at %) | V (at %) | Si (at %) |
|---|---|---|---|---|---|
| 1 | 25 | 25 | 25 | 25 | — |
| 2 | 25 | 20 | 30 | 25 | — |
| 3 | 25 | 12.5 | 37.5 | 25 | — |
| 4 | 24.625 | 24.625 | 24.625 | 24.625 | 1.5 |

Pure Cr, pure Ti, pure Si and a master alloy of 35 wt % Al and 65 wt % V were used as raw materials in these experiments. Raw materials were arc-melted into buttons on a water-cooled copper hearth under an ultra-high purity argon atmosphere. To promote uniformity of composition, each button was flipped and re-melted a total of four times before being allowed to cool to room temperature. The mass of each button was in the range of 4-7 g.

The materials of Examples 1-3 had the following actually-measured compositions:

| Example | Al (at %) | Cr (at %) | Ti (at %) | V (at %) |
|---|---|---|---|---|
| 1 | 28 | 24 | 24 | 24 |
| 2 | 28 | 20 | 28 | 24 |
| 3 | 28 | 12 | 36 | 24 |

Figure 2:
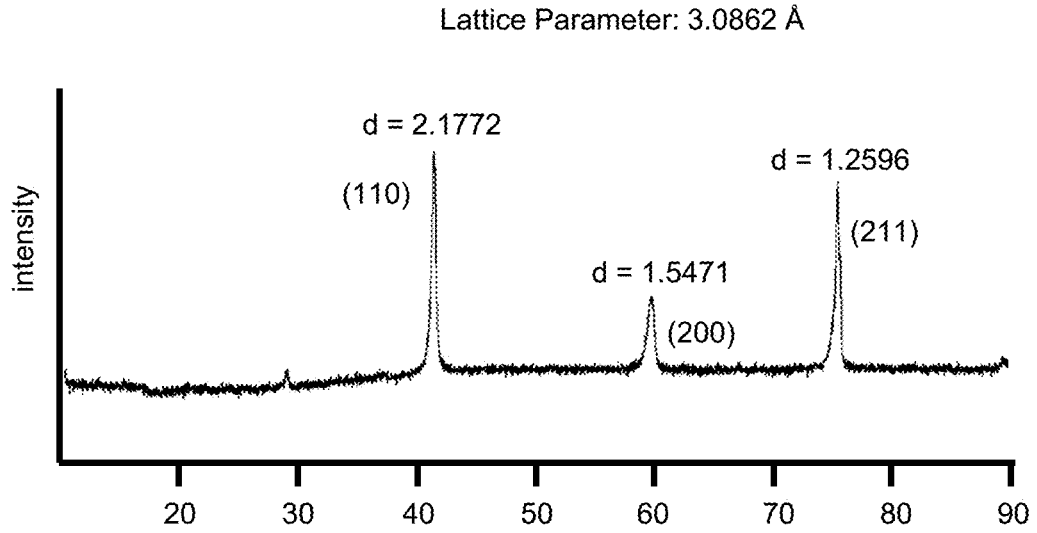
FIG. 2 is an X-ray diffraction pattern of the material of Example 2.
Figure 3:
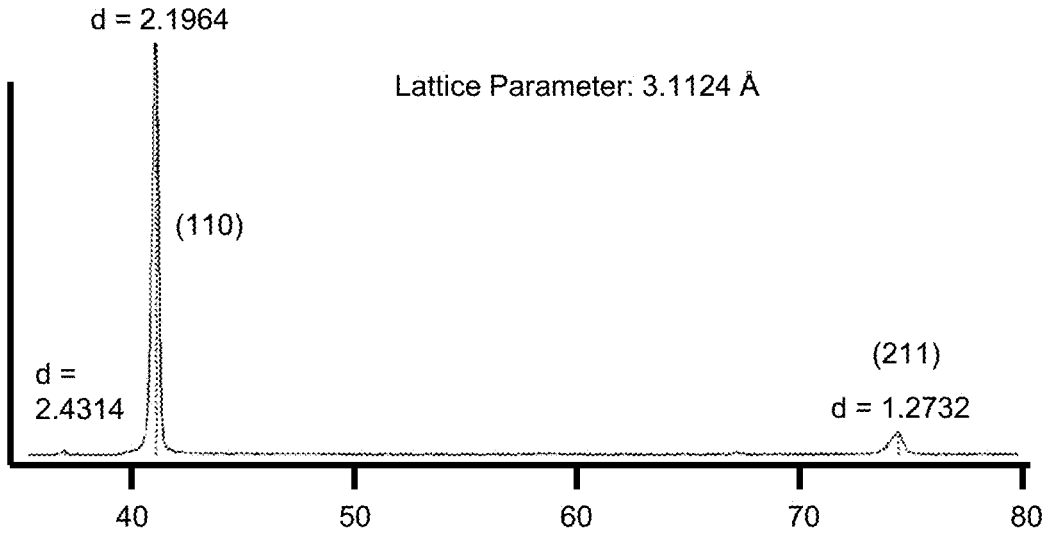
FIG. 3 is an X-ray diffraction pattern of the material of Example 3.
Figure 4:
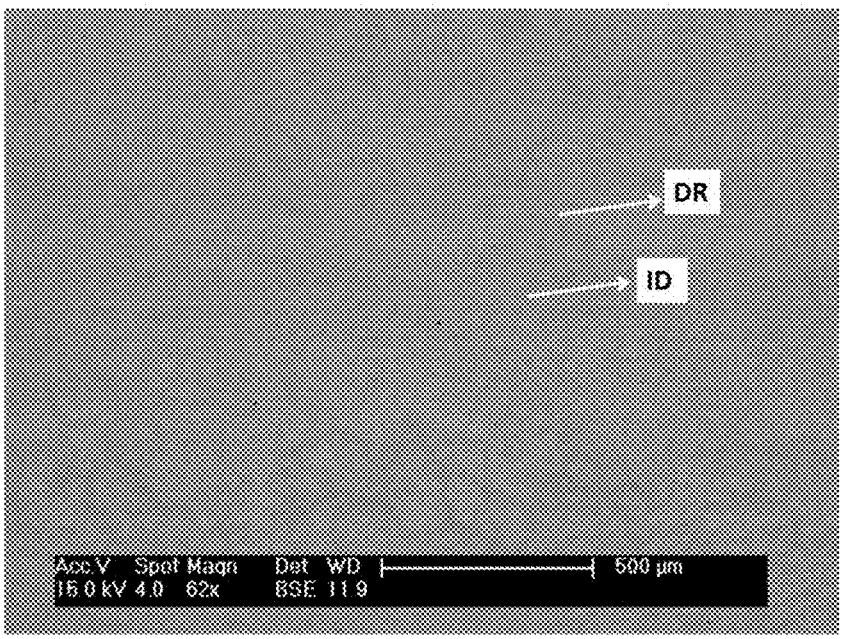
FIG. 4 is a backscattered electron image of the microstructure of the as-cast alloy of the material of Example 1.
Figure 5:
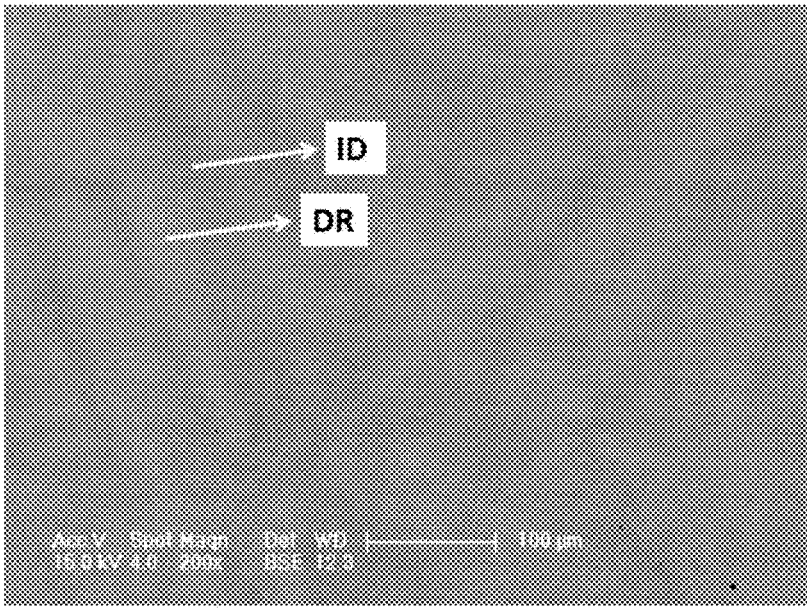
FIG. 5 is a backscattered electron image of the microstructure of the as-cast alloy of the material of Example 2.
Figure 6:
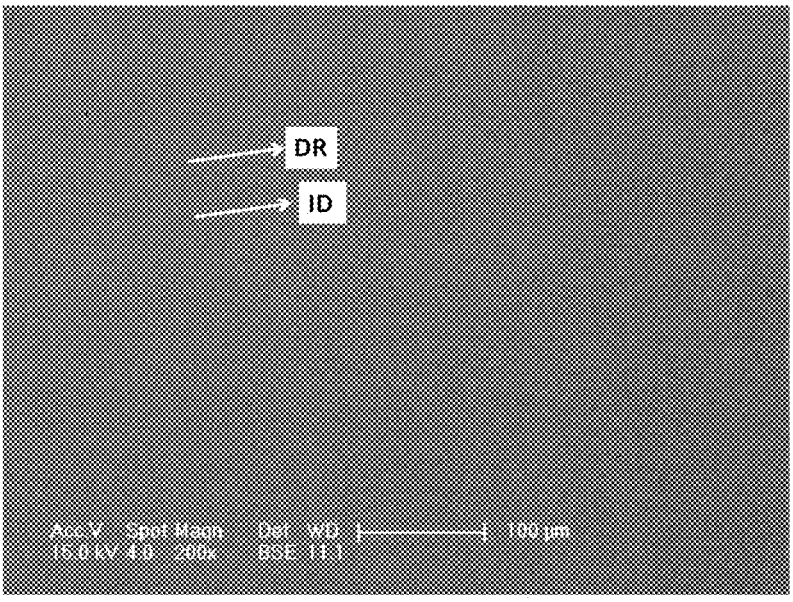
FIG. 6 is a backscattered electron image of the microstructure of the as-cast alloy of the material of Example 3.

FIGS. 1-3 provide a set of X-ray diffraction patterns of the as-cast alloys of Examples 1, 2 and 3, respectively. Notably, the BCC_A2 phase is the dominant phase identified by the XRD patterns. FIGS. 4-6 provide back scattered electron (BSE) images of the microstructures of the as-cast alloys of Examples 1, 2 and 3, respectively. As is common for such materials, the as-cast microstructure is composed chiefly of dendritic regions (DR), which are separated by inter-dendritic regions (ID). Energy-Dispersive Spectroscopy (EDS) line scanning was performed on these alloys; the compositions were generally uniform and the microsegregation of the elements is weak. All of the microstructure characterizations demonstrate that the alloys have the solid solution phase Bcc_A2 as the dominant phase.

Figure 7:
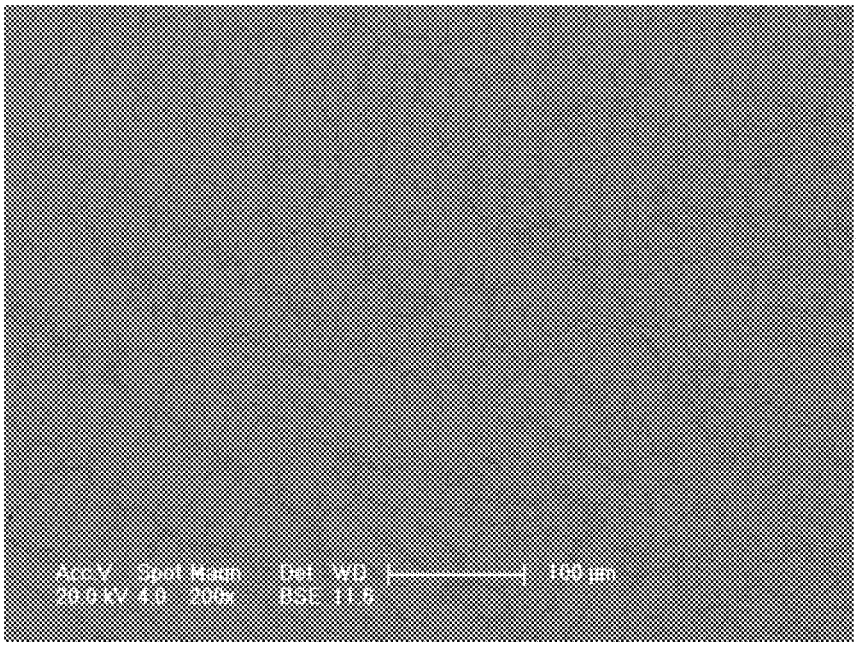
FIG. 7 is a backscattered electron image of the microstructure of the as-cast alloy of Example 4 at 200×.
Figure 8:
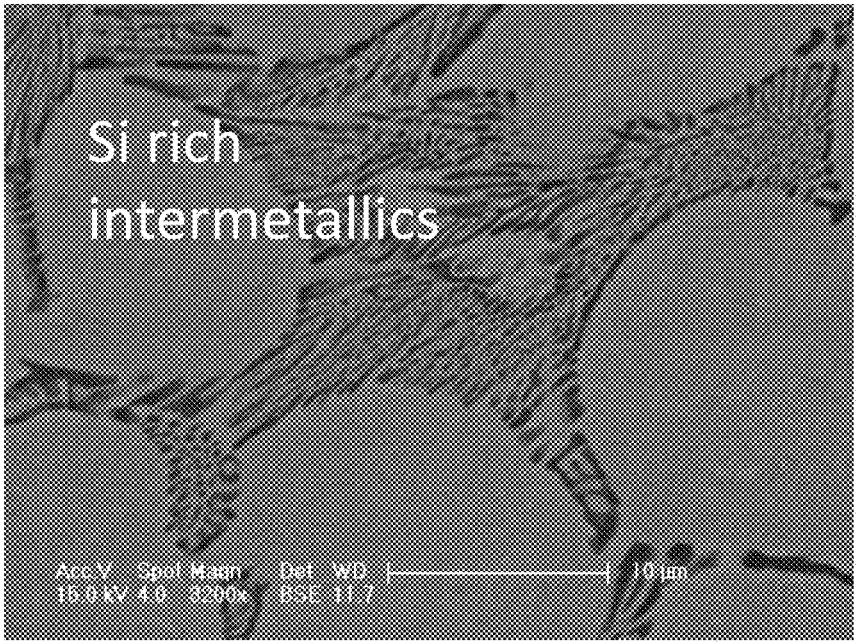
FIG. 8 is a backscattered electron image of the microstructure of the as-cast alloy of Example 4 at 3200×.

FIGS. 7 and 8 are backscattered electron (BSE) images of the microstructure of the as-cast alloy of Example 4, at 200× and 3200× magnifications, respectively. The BSE image demonstrates that there is intermetallic in the inter-dendritic region; EDS results reveal that the intermetallic is rich in Si.

Figure 9:
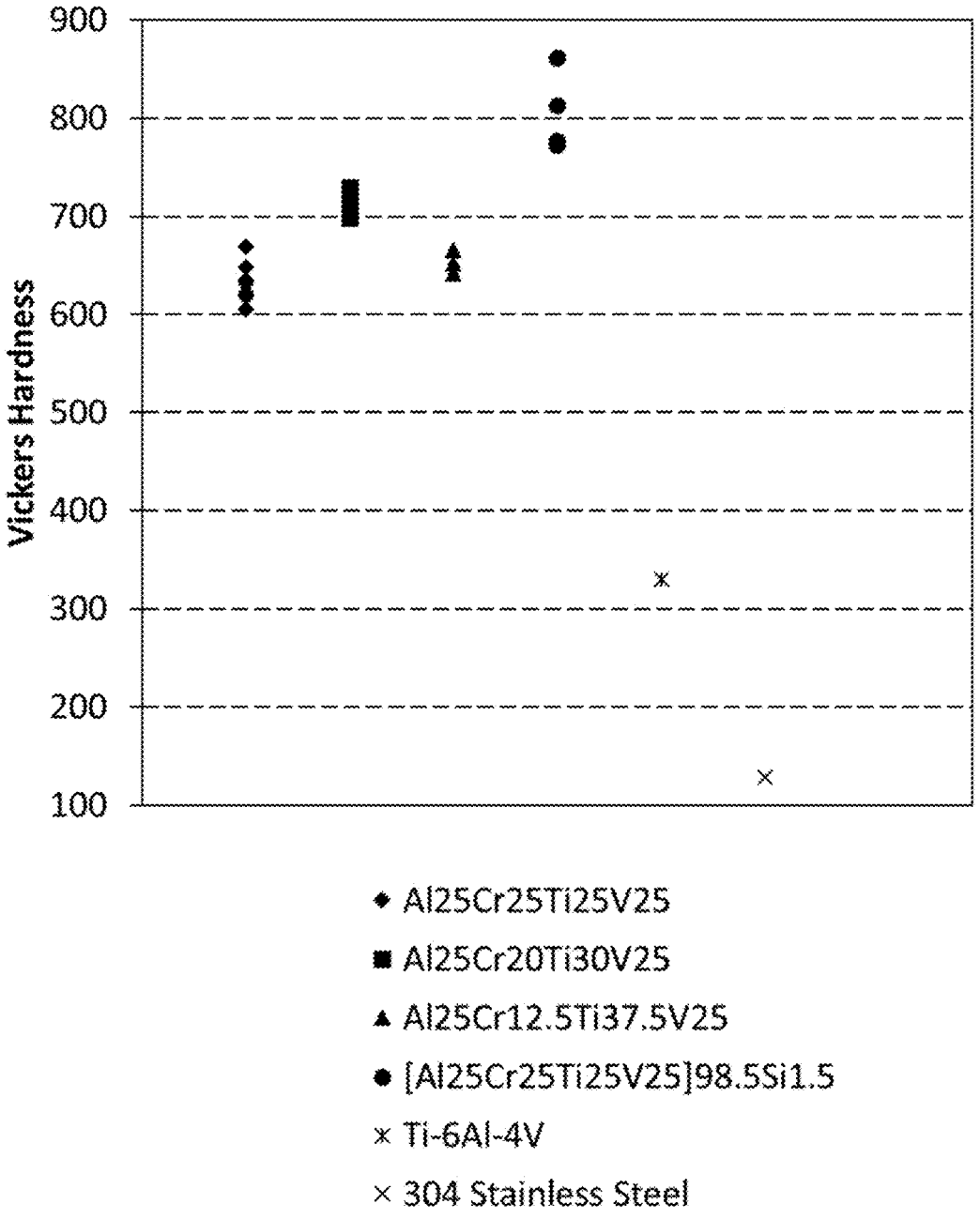
FIG. 9 is a plot of Vickers hardness data for the alloys of Examples 1-4 and for two comparative materials.

Vickers hardness data (in triplicate) are provided in FIG. 9. The Vickers hardness data demonstrate that the alloys have high hardness, and thus have the potential to perform as high-strength structural alloys. Vickers hardness data are also provided for 304 stainless steel and the alloy Ti-6Al-4V. The alloys described herein are much harder than 304 stainless steel and Ti-6Al-4V.

While densities of the Example alloys were not measured, The densities of Al, Cr, Ti and V are 2.7, 7.14, 4.507 and 6.11 g/cm$^3$, respectively. Since the Al—Cr—Ti—V alloys have two light elements Al and Ti, their densities based on the theoretical rule of mixtures are expected be substantially less than those of many other high-entropy alloys, such as the conventional AlCoCrFeNi alloys.

Two additional Example compositions were prepared as described above, having the nominal compositions shown below:

| Example | Al (at %) | Cr (at %) | Ti (at %) | V (at %) | Si (at %) |
|---|---|---|---|---|---|
| 5 | 15 | 25 | 45 | 15 | — |
| 6 | 14.775 | 24.625 | 44.325 | 14.775 | 1.5 |

Figure 10:
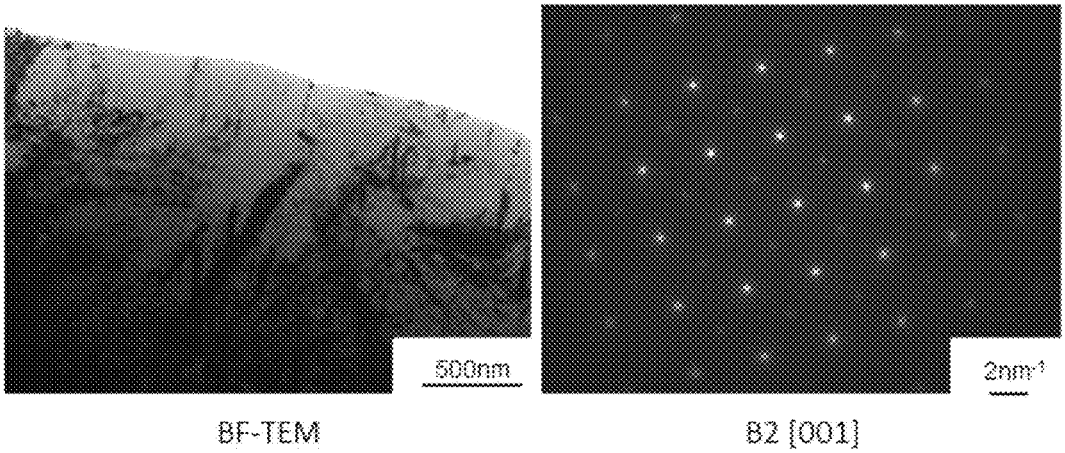
FIG. 10 is a bright-field TEM image of the material of Example 5, together with a selected-area electron diffraction pattern from the [011] direction.
Figure 11:
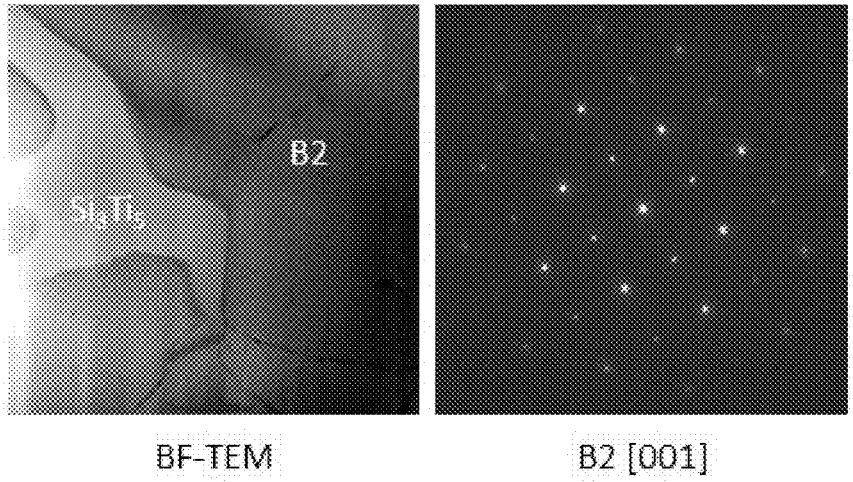
FIG. 11 is a bright-field TEM image of the material of Example 6, together with a selected-area electron diffraction pattern from the [011] direction.

FIG. 10 is a bright-field TEM image of the material of Example 5 (nominally $Al_{15}Cr_{25}Ti_{45}V_{15}$), together with a selected-area electron diffraction (SAED) pattern from the [001] direction. FIG. 10 demonstrates that this material consists of a single body-centered cubic phase. The SAED pattern shows B2 superlattice reflection, which indicates that the solid solution phase has an ordered or partial-ordered body-centered cubic crystal structure. FIG. 11 is the bright field TEM image and an SAED pattern ([001] direction) of the material of Example 6. The dark area in the bright field TEM image is solid solution matrix, and the bright area is $Ti_5S_{i3}$ precipitate. The SAED pattern of the matrix also shows B2 superlattice reflection, so in this material, the matrix is also an ordered or partially-ordered body-centered cubic phase.

CALculation of PHAse Diagrams (CALPHAD) thermodynamic calculations were performed on the Al—Cr—Ti—V system. The thermodynamic database from H. Wang, N. Warnken, R. C. Reed, "Thermodynamic assessment of the ordered B2 phase in the Ti—V—Cr—Al quaternary system," Calphad, 35, 204-208 (2011) and Thermo-Calc software developed by Thermo-Calc company are used.

Figure 12:
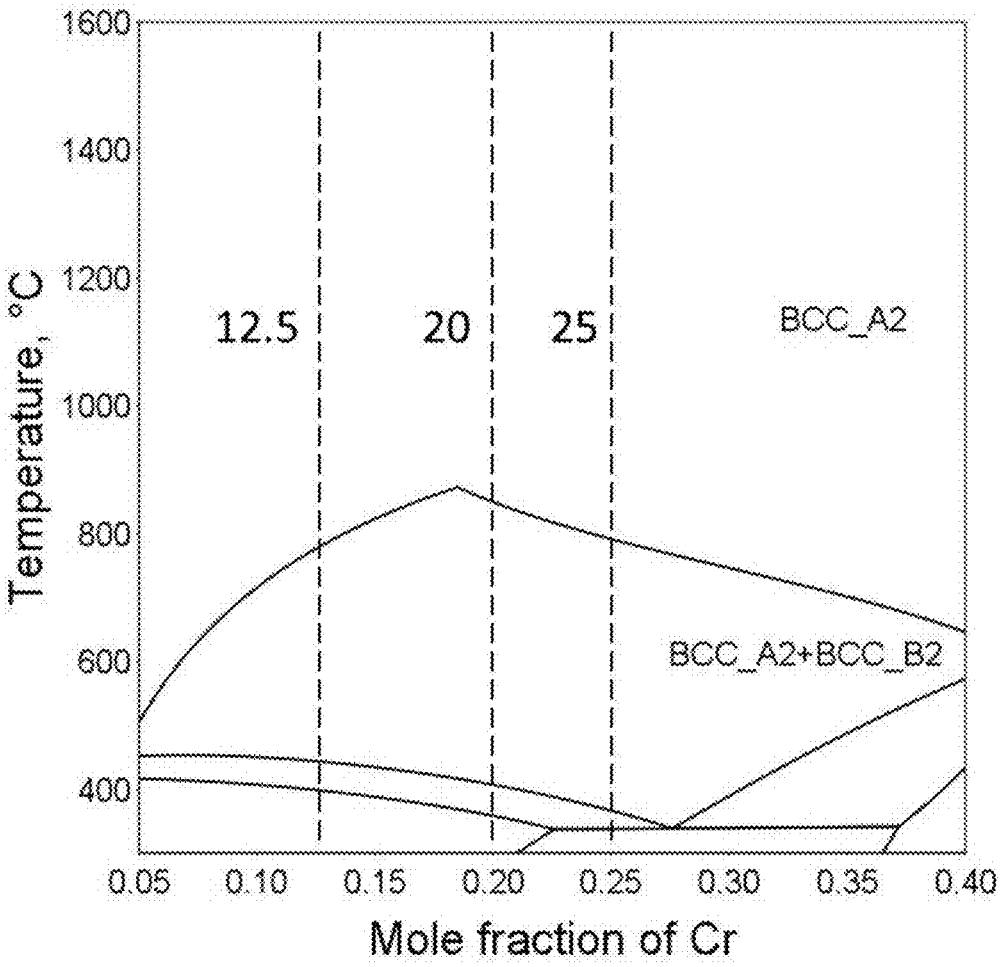
FIG. 12 is a calculated equilibrium phase diagram for the system of $Al_{25}Cr_{(50-x)}Ti_xV_{25}$.
Figure 13:
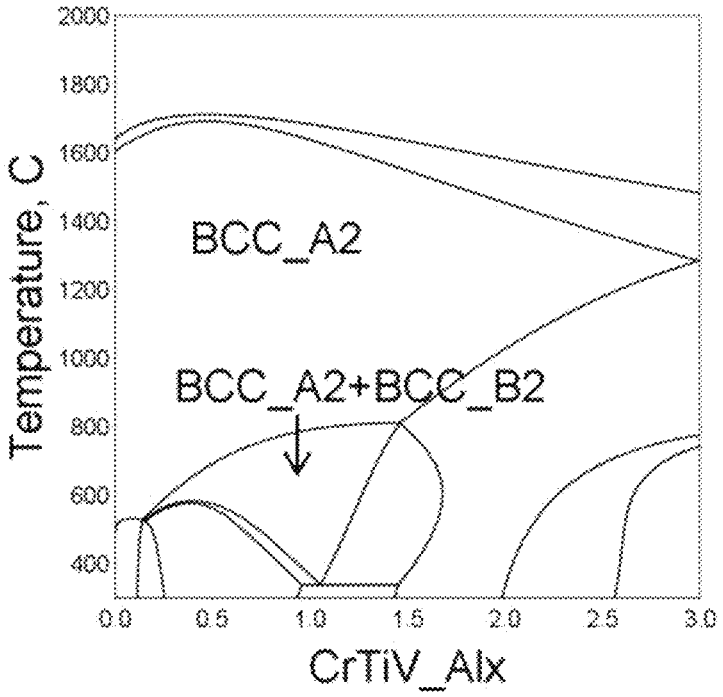
FIGS. 13-16 are a set of calculated vertical sections of the equilibrium phase diagrams of the Al—Cr—Ti—V system.
Figure 14:
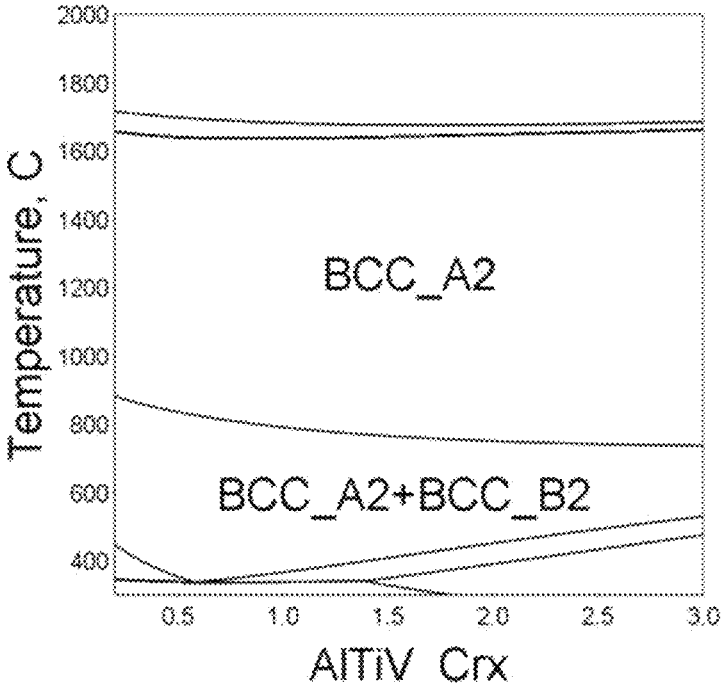
Figure 15:
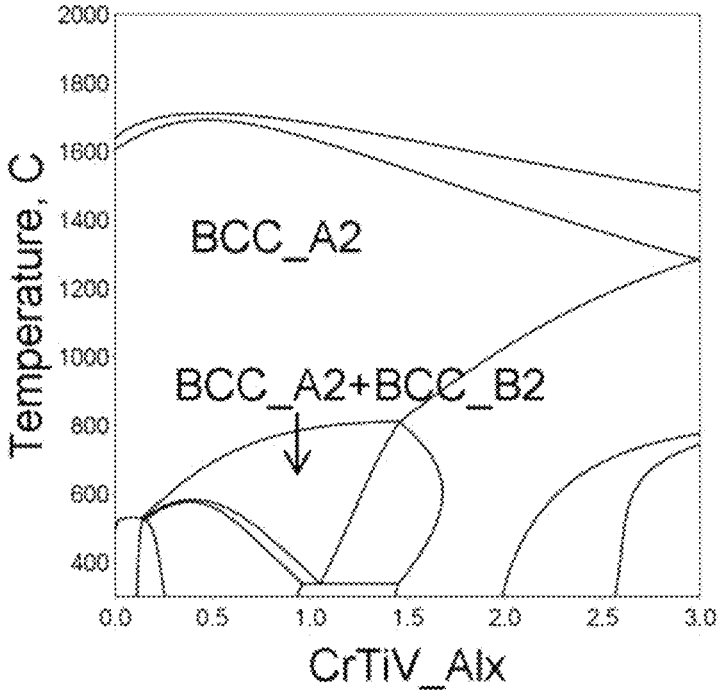
Figure 16:
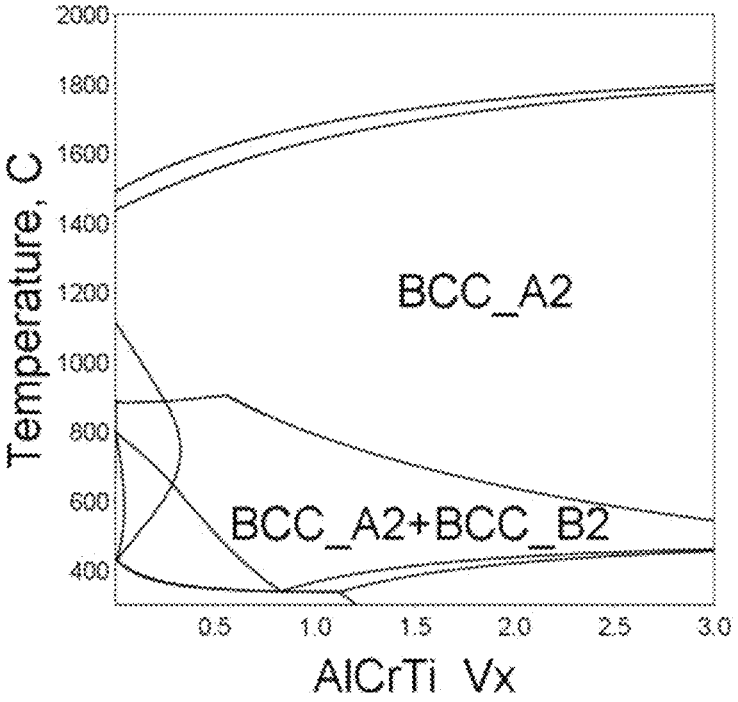

FIG. 12 is a calculated equilibrium phase diagram for the system of $Al_{25}Cr_{(50-x)}Ti_xV_{25}$. Vertical dashed lines are provide for X=25, 20, and 12.5, which correspond to the nominal formulae of Examples 1, 2 and 3 respectively. FIGS. 13-16 provide a set of calculated vertical sections of the equilibrium phase diagrams of the Al—Cr—Ti—V system. In each, the x-axis indicates the atomic ratio between each element; for example AlTiV_Crx indicates that the atomic ratio of Al, Ti, V and Cr is 1:1:1:x. These phase diagrams reveal that there are wide solid solution BCC_A2 and BCC_A2+BCC_B2 phase regions below the liquidus in the Al—Cr—Ti—V system.

Figure 17:
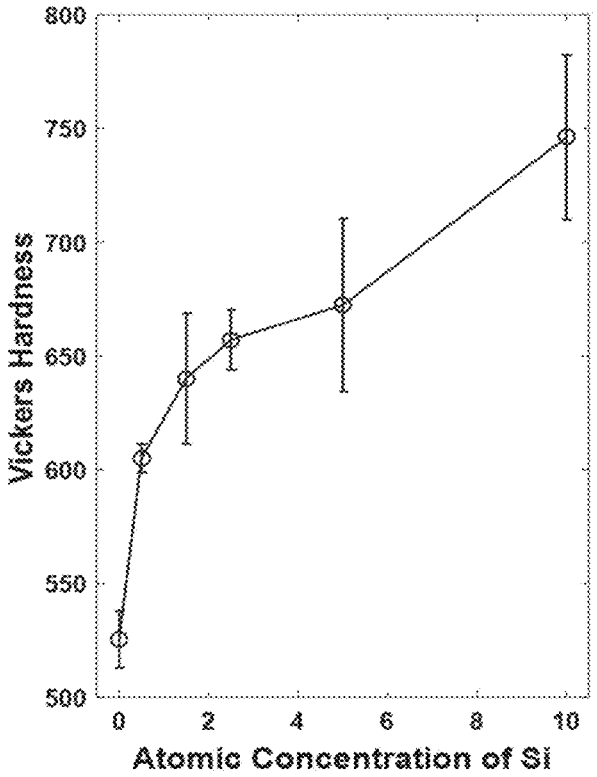
FIGS. 17-19 are graphs of hardness data vs. additive concentration for alloys with Si, B and C additives, respectively.
Figure 18:
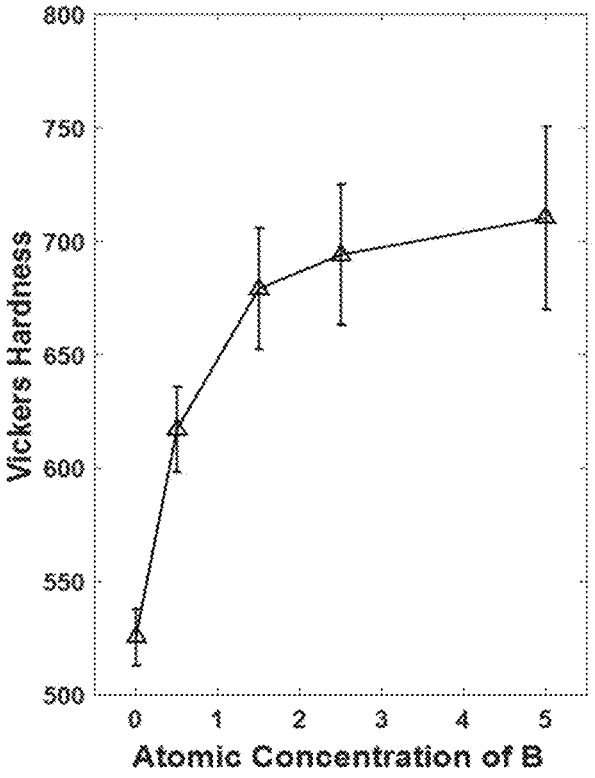
Figure 19:
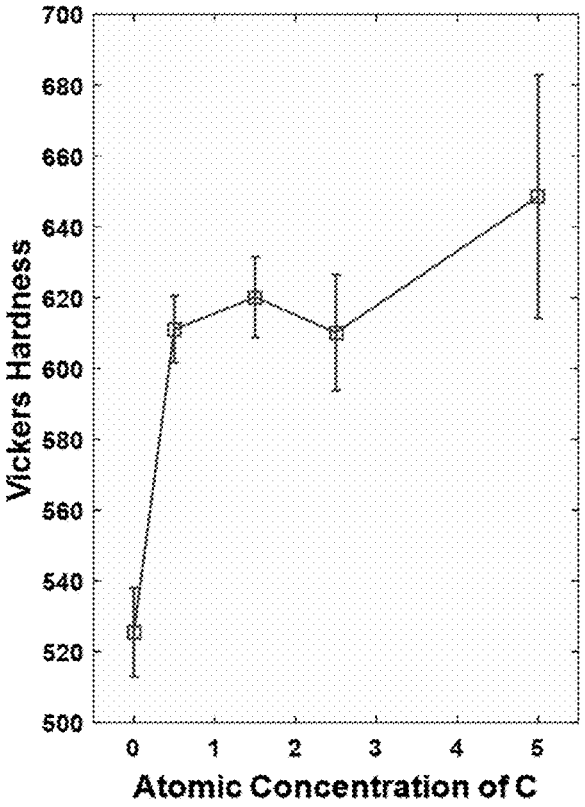
Figure 20:
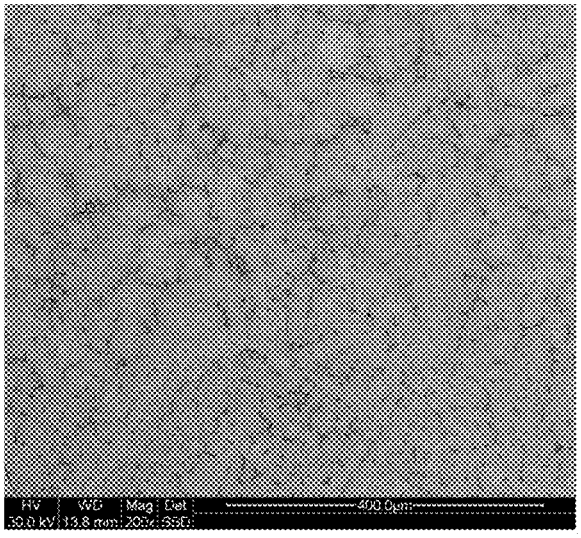

Additional Example compositions were made, using an equiatomic AlCrTiV alloy as the base alloy, with varying nominal amounts of silicon, boron, and carbon. Hardness data are shown in FIGS. 17-19, respectively, for Si, B and C. And FIGS. 20-22 are set of micrographs showing the microstructure of the materials including carbon at nominal 0.5 at %, 1.5 at % and 5 at % carbon, demonstrating increasing amounts of precipitate with increasing amounts of carbon. The data indicate that the hardness increases with increasing silicon, boron or carbon content, with boron having the most potent effect. While not intending to be bound by theory, the inventors believe that the increase in hardness is related to the increasing volume fraction of precipitate.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A multiple-principal-element AlCrTiV metal alloy comprising

Al in an amount of 20-40 at %;

Cr in an amount of 10-30 at %;

Ti in an amount of 20-40 at %; and

V in an amount of 20-40 at %, wherein the total amount of Al, Cr, Ti and V is at least 90 at %, and wherein the amount of Si in the alloy is less than 0.5 at %.

2. The alloy of claim 1, wherein the total amount of Al, Cr, Ti and V is at least 95 at %.

3. The alloy of claim 1, further comprising C in an amount up to 10 at %.

4. The alloy of claim 1, further comprising B in an amount up to 10 at %.

5. The alloy of claim 1, further comprising one or more additional components selected from Mo, W, Nb, Ta, Hf, Zr, Co, Ni, Fe, Pd, Re, Y, Sc, Rh, Be, Mg, Cu, Zn, Ru, Ag, Au, Pt, La, Ce, Pr, Nd, Sm, Eu, Gd, Tb, Na, Li, Ga, Ge, Sr, Sn, Cd and In.

6. The alloy of claim 5, wherein the alloy comprises less than 0.5 at % of any other metal.

7. The alloy of claim 1, further comprising one or more additional metallic components selected from W, Mo, Nb, Zr, Be and Li.

8. The alloy of claim 7, wherein the alloy comprises less than 0.5 at % of any other metal.

9. The alloy of claim 1, wherein no single elemental component other than the Al, the Cr, the Ti or the V is present in an amount in excess of 10 at %.

10. The alloy of claim 1, having no more than 3 at % O.

11. The alloy of claim 1, wherein the alloy is at least 80 vol % in a single solid solution phase.

12. The alloy of claim 11, wherein the alloy is at least 90 vol % in an at least partially-ordered body-centered cubic phase.

13. The alloy of claim 1, wherein the alloy is in a plurality of phases, and wherein at least 50 vol % of the alloy is in an at least partially-ordered body-centered cubic phase.

14. The alloy of claim 1, having a Vickers hardness of at least 550.

15. The alloy of claim 1, having a density of no more than 5.5 g/cm$^3$.

16. The alloy of claim 1, wherein

Al is present in an amount of 20-30 at %;

Cr is present in an amount of 20-30 at %;

Ti is present in an amount of 20-30 at %; and

V is present in an amount of 20-30 at %.

17. The alloy of claim 1, wherein

Al is present in an amount of 20-30 at %;

Cr is present in an amount of 15-25 at %;

Ti is present in an amount of 25-35 at %; and

V is present in an amount of 20-30 at %.

18. The alloy of claim 1, wherein Cr is present in an amount of 20-30 at %.

* * * * *